US005313179A

United States Patent [19]

Moeller

[11] Patent Number: 5,313,179

[45] Date of Patent: May 17, 1994

[54] DISTRIBUTED WINDOW FOR LARGE DIAMETER WAVEGUIDES

[75] Inventor: Charles P. Moeller, Del Mar, Calif.

[73] Assignee: General Atomics, San Diego, Calif.

[21] Appl. No.: 958,029

[22] Filed: Oct. 7, 1992

[51] Int. Cl.[5] ..... H01P 1/08

[52] U.S. Cl. ..... 333/252; 333/251

[58] Field of Search ..... 333/251, 252

[56] References Cited

U.S. PATENT DOCUMENTS

| | | | |
|---|---|---|---|
| 4,286,240 | 8/1981 | Shively et al. | 333/252 |
| 4,523,127 | 6/1985 | Moeller | 315/4 |
| 4,604,551 | 8/1986 | Moeller | 315/4 |
| 4,620,170 | 10/1986 | Lavering | 333/252 |
| 4,680,558 | 7/1987 | Ghosh et al. | 333/21 R |
| 4,704,589 | 11/1987 | Moeller | 333/113 |
| 4,956,620 | 9/1990 | Moeller | 333/21 R |
| 5,030,929 | 7/1991 | Moeller | 333/21 R |
| 5,043,629 | 8/1991 | Doane | 315/5 |
| 5,051,715 | 9/1991 | Agosti et al. | 333/252 |
| 5,061,912 | 10/1991 | Moeller | 333/113 |

FOREIGN PATENT DOCUMENTS

| | | | |
|---|---|---|---|
| 465485 | 1/1992 | European Pat. Off. | 333/252 |

OTHER PUBLICATIONS

Doane, "Low Loss Propagation is Corrugated Rectangular Waveguide at 1mm Wavelight", *International Journal of Infrared and Millimeter Waves*, 8:1 (1987).

*Waveguide Handbook*, Massachusetts Institute of Technology, Radiation Laboratory Series, Edited by N. Marcuvitz; pp. 63-81 (1951).

*Primary Examiner*—Paul Gensler

*Attorney, Agent, or Firm*—Fitch, Even, Tabin & Flannery

[57] ABSTRACT

A distributed microwave window couples microwave power in the $HE_{11}$ mode between a first large diameter waveguide and a second large diameter waveguide, while providing a physical barrier between the two waveguides, without the need for any transitions to other shapes or diameters. The window comprises a stack of alternating dielectric and hollow metallic strips, brazed together to form a vacuum barrier. The vacuum barrier is either transverse to or tilted with respect to the waveguide axis. The strips are oriented to be perpendicular to the transverse electric field of the incident microwave power. A suitable coolant flows through the metallic strips. The metallic strips are tapered on both sides of the vacuum barrier, which taper serves to funnel the incident microwave power through the dielectric strips.

20 Claims, 4 Drawing Sheets

DISTRIBUTED WINDOW FOR LARGE DIAMETER WAVEGUIDES

BACKGROUND OF THE INVENTION

The present invention relates to large diameter microwave waveguides, and more particularly to a distributed window that may be used in such waveguides to couple high frequency, high power microwave radiation through a vacuum barrier within the waveguide without overheating, significant mode conversion, or reflection of incident power.

A waveguide window in a microwave power system permits power to be coupled from a first waveguide to a second waveguide, but presents a physical barrier between the two waveguides. The physical barrier allows the waveguides to contain different gases or to be at different pressures, and one or both waveguides may be evacuated. For example, in high power microwave vacuum devices, such as gyrotrons and the like, the output power must be coupled between an evacuated chamber or waveguide in the gyrotron device, through one or more waveguide windows, into a waveguide having a gaseous environment. The one or more waveguide windows thus provide a hermetic seal between the two media. Also, in fusion reactors where microwave power is added to a plasma, the physical barrier of a microwave window may be placed near the reactor to confine the constituents of the plasma.

One type of microwave window known in the art is described in U.S. Pat. No. 5,061,912, incorporated herein by reference. A similar type of window is described in U.S. patent application Ser. No. 07/898,502; filed Jun. 06, 1992, also incorporated herein by reference. The types of microwave windows disclosed in the '912 patent and the '502 application are distributed windows that form part of a phase velocity coupler. The type of coupling provided by the described windows is between two identical corrugated rectangular waveguides, each of which is many (e.g.,>15) free space wavelengths, $\lambda_0$, wide in one transverse dimension but only 2 to 3 $\lambda_0$ in the other dimension. A transition from circular corrugated waveguide many $\lambda_0$ in diameter propagating the $HE_{11}$ mode, which is a preferred method of low loss transmission for high power millimeter wavelength microwaves, to this rectangular corrugated waveguide, can always be made. However, if the circular waveguide is very large, e.g., $30\lambda_0$ in diameter, many modes which can propagate in the larger circular waveguide are cut off in the rectangular waveguide. Although ideally, only one mode is emitted from the source, typically a gyrotron, and propagated through the system, in reality there is often a few percent of other modes present, which might be reflected back to the source with deleterious effects by such a transition. Hence, there is a need in the art for a microwave window that can be used to directly and efficiently couple high frequency microwave power between two large diameter waveguides without the need for any transitions to other shapes and sizes.

There also exists a new generation of gyrotrons, such as the Russion 500kw, 110 and 140 GHz gyrotrons which have the $HE_{11}$ output mode, which are most compatible with a large output diameter. Unfortunately, a suitable CW vacuum window does not presently exist for such large diameters.

The present invention addresses the above and other needs.

SUMMARY OF THE INVENTION

In accordance with one aspect of the present invention, there is provided a distributed microwave window suitable for large size waveguides, e.g., waveguides having a diameter on the order of 8.8 cm at 110 GHz, that does not require any transitions to other shapes or diameters. The window includes a barrier formed from a stack of alternating dielectric and hollow metallic strips, brazed together to make good thermal contact with each other and to form a vacuum seal. The hollow metallic strips are positioned to be perpendicular to the transverse electric field of the incident wave. The metallic strips further include a specified taper that deflects the incident microwave power away from the metallic strips and through the dielectric strips. A coolant is pumped through the hollow metallic strips in order to remove heat generated at the dielectric strips by the microwave power passing therethrough.

In accordance with another aspect of the invention, the microwave power that passes through the distributed window emerges in the $HE_{11}$ mode.

In accordance with still another aspect of the invention, the vacuum barrier is positioned to be either transverse to the waveguide axis or tilted with respect to the waveguide axis. When tilted, any incident microwave power that may be of the wrong mode or wrong polarization is advantageously reflected off of the barrier into an absorber.

One embodiment of the invention may be characterized as a distributed microwave window for use within a microwave waveguide. Such distributed microwave window includes a plurality of alternating dielectric and metallic strips stacked and sealed to form a vacuum barrier. The vacuum barrier is positioned and sealed so as to provide a physical barrier within the interior of the waveguide. Further, each of the plurality of dielectric strips has a substantially rectangular cross-sectional shape, with a first set of opposing sides being sealed to respective sides of adjacent ones of the metallic strips, and with a second set of opposing sides fronting the interior of the waveguide. Comparably, each of the metallic strips has a substantially hexagonal cross-sectional shape, with a first set of opposing sides being sealed to respective sides of adjacent ones of the dielectric strips, and with a second and third set of opposing sides of the hexagonal-shaped metallic strip being exposed to the interior of the waveguide in accordance with a prescribed taper.

Another embodiment of the invention may be characterized as coupling apparatus for directly coupling microwave power between the $HE_{11}$ mode in a first waveguide to the $HE_{11}$ mode in a second waveguide. Such coupling apparatus includes a vacuum barrier separating the first and second waveguides. The vacuum barrier includes a plurality of parallel dielectric strips, with each dielectric strip being separated from an adjacent dielectric strip by a cooling strip. The distance between a center line of adjacent dielectric strips is approximately a distance h, where $h<\lambda_0$, and where $\lambda_0$ is the free space wavelength associated with the microwave power being coupled between the first and second waveguides. For proper coupling to occur, the dielectric strips of the vacuum barrier are oriented to be perpendicular to an electric field component of the microwave power. As required, each cooling strip may include one or more cooling channels through which a suitable coolant, such as water, may flow in order to remove heat from the dielectric strips, which dielectric strips are in good thermal contact with the cooling strips.

It is a feature of the invention to provide a microwave window that may be used directly with large size or large diameter waveguides, e.g., waveguides having a diameter on the order of $30\lambda_0$ or larger.

It is another feature of the invention to provide a microwave window that may couple microwave power in the $HE_{11}$ mode from one large diameter waveguide to another without the need for any transitions to other shapes or diameters.

It is an additional feature of the invention to provide a microwave window that includes cooling means for efficiently removing heat from a vacuum barrier that defines such microwave window.

It is yet another feature of the invention to provide a microwave window that includes a vacuum barrier that may be transverse to the waveguide axis, or tilted with respect to the waveguide axis; and that when tilted provides for the deflection of microwave power of an unwanted mode, or microwave power of the wrong polarization, into an absorber.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Referring to FIG. I, there is shown an input waveguide 32 coupled to an output waveguide 34 by a window barrier 12. The window barrier 12, described in more detail below, provides a physical barrier between the waveguide 32 and the waveguide 34, thereby allowing different gases and/or pressures to be present on each side of the barrier 12. Both the input waveguide 32 and the output waveguide 34 are large diameter waveguides, having a diameter that is typically at least $30\lambda_0$, where $\lambda_0$ is the free space wavelength of the microwave power that is propagating in the waveguide. While the waveguides 32 and 34 shown in FIG. 1 are depicted as circular waveguides, which is normally the preferred type of waveguide for transmission of high power microwaves propagating in the $HE_{11}$ mode, it is to be understood that the input and output waveguides could also be rectangular waveguides, if desired.

Figure 1:
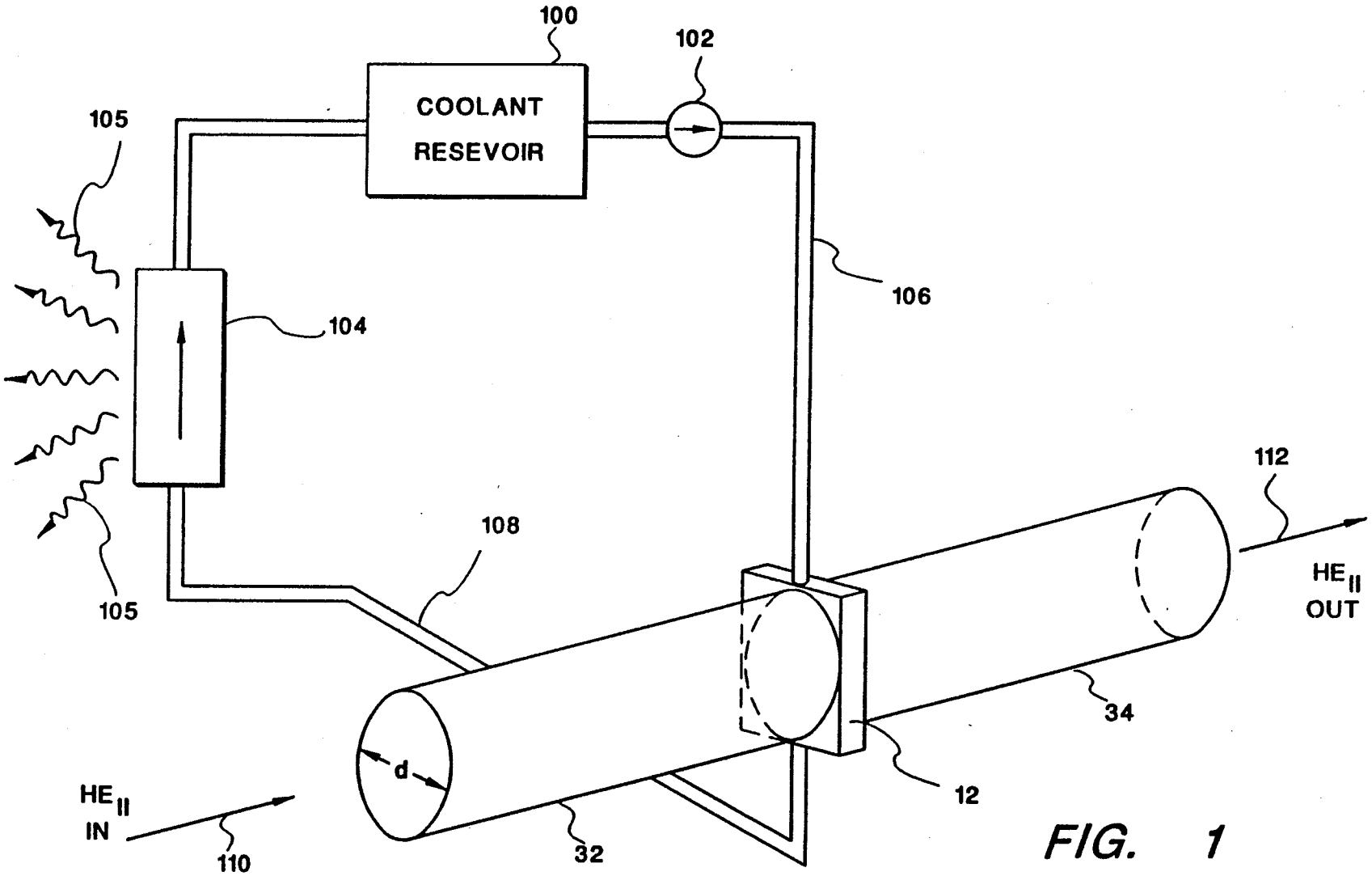
FIG. 1 shows a distributed window made in accordance with the present invention that couples two large diameter waveguides.

As suggested in FIG. 1, one of the advantages of the present invention is that the input microwave power, represented in FIG. 1 by the arrow 110, may be in the $HE_{11}$ mode; and the output power, represented in FIG. 1 by the arrow 112, also emerges in the $HE_{11}$ mode. The microwave power is thus able to pass through the barrier 12 without the need for conversion to other modes, or without the need to change to other types or shapes of waveguide.

For ease of construction, the barrier 12 should normally be constructed to have a rectangular cross section, as suggested in FIG. 1. That is, as will be evident from the description that follows, the barrier 12 is made up of a series of columns or strips, joined together at their edges, to form a wall. It is easier to manufacture the barrier 12 if all such columns or strips are of approximately the same length. The resulting wall or barrier 12 is then preferably housed in a rectangular housing, which housing is sealed to the ends of the waveguides 32 and 34. It is to be understood, however, that the barrier 12 may also be made from columns or strips that are not of the same length, in which case the barrier 12 may have a cross-sectional shape that is other than rectangular, e.g., circular.

As shown in FIG. 1, and as described more fully below, as the microwave power passes through the barrier 12, some power will be absorbed. In order to remove the heat associated with such absorbed power, a suitable coolant, such as water, or Syltherm 800, commercially available from the Dow Chemical Company, is pumped through coolant channels that form an integral part of the barrier 12. The coolant is stored in a coolant reservoir 100, or equivalent, and pumped by a pump 102 through a suitable coolant feed network 106 to the barrier 12. The coolant passes through the coolant channels of the barrier 12, gathering heat as it so passes, and returns through a suitable coolant return network 108 to a heat transfer element 104. The element 104 removes the heat, represented by the wavy arrows 105, from the coolant. The heat transfer element 104 may be, for example, a radiator. After sufficient heat is removed from the coolant, it is returned to the coolant reservoir 100 for recycling back through the barrier 12. Other schemes for cycling a suitable coolant through the barrier 12, other than that shown in FIG. 1, may also be used. For example, if a suitable source of water is available at a sufficient water pressure, the water pressure may be used as the "pump" to force the water through the barrier 12, and the radiator 104 may simply be the ambient atmosphere.

Figure 2A:
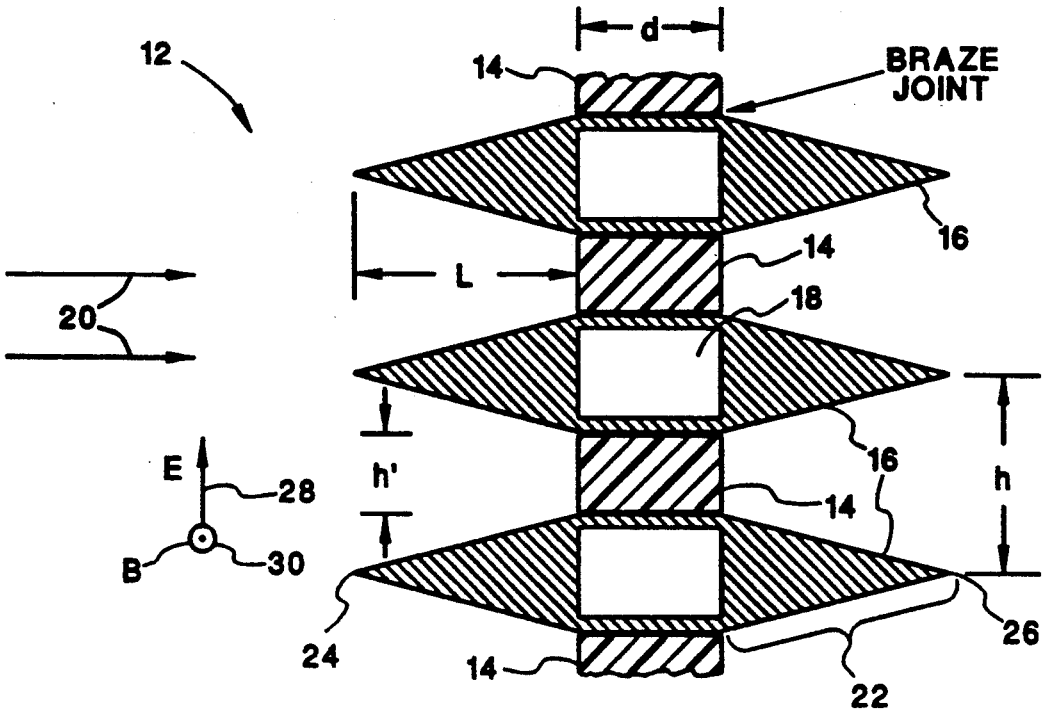
FIG. 2A shows a typical cross-sectional view of a portion of a barrier used to form the microwave window in accordance with the present invention.

The present invention thus provides a distributed microwave window that allows the efficient transfer of microwave power in the $HE_{11}$ mode from one large size (e.g., large diameter) waveguide 32 to another large size waveguide 34 without the need for any transitions to other waveguides of differing shapes or diameters. The invention basically comprises a vacuum barrier 12 that is inserted between the large size waveguides 32 and 34 so as to provide a vacuum seal and a physical barrier between the sections of the waveguide separated by such barrier. A typical cross-sectional view of a portion of such a barrier is shown in FIG. 2A. As seen in FIG. 2A, the barrier 12 is formed within the waveguide by stacking alternating dielectric strips 14 with metallic strips 16. Each of the metallic strips 16 has a coolant channel 18 therein. Thus, the metallic strips may be referred to as hollow metallic strips 16.

The metallic strips 16 also include a taper 22 that protrudes out from both sides of a plane defined by the dielectric strips 14. As shown in FIG. 2A, which figure shows a sectional view of the dielectric strips 14 and the metallic strips 16, the dielectric strips 14 each have a rectangular cross-sectional shape, while the metallic strips 16 each have basically a hexagonal cross-sectional shape. A first set of opposing sides of the rectangular cross-sectional shape of the dielectric strips 14 adjoin corresponding opposing sides of the hexagonal cross-sectional shape of the metallic strips. A second set of opposing sides of the rectangular cross-sectional shape of the dielectric strips 14 front the interior of the waveguide wherein the barrier 12 is located. That is, a first side of such second set of opposing sides of the rectangular cross-sectional shape faces the incident microwave power, represented in FIG. 2A by the arrows 20, that is propagating through the waveguide. A second side of such second set of opposing sides faces away from the incident microwave power, on the opposite side of the barrier 12.

As further seen in FIG. 2A, a first set of opposing sides of the hexagonal cross-sectional shape of the metallic strips 16 adjoin the corresponding first set of opposing sides of the rectangular cross-sectional shape of the dielectric strips 14. In practice, in order that the barrier 12 form a vacuum seal, the dielectric strips 14 are brazed, or otherwise securely bonded, to the metallic strips 16 along the full length of such adjoining sides. The taper 22 of the metallic strips 16 is formed by second and third sets of opposing sides of the hexagonal-shaped metallic strip extending out from the plane defined by the dielectric strips 14. As shown in FIG. 2A, a first side of the second and third sets of opposing sides extends out from the barrier 12 on the incident power side of such barrier, forming a tip or ridge 24 of such taper; while a second side of the second and third sets of opposing sides extends out from the barrier 12 on the back side (opposite the incident power) of such barrier, forming a tip or ridge 26. The tip or ridge 24 is spaced a distance L from the front surface of the plane defined by the dielectric strips 14, where "front" is used to refer to the side of the barrier 12 facing the incident power 20. Similarly, the tip or ridge 26 is spaced a distance L from the back surface of the plane defined by the dielectric strips 14, where "back" is used to refer to the side of the barrier opposite the incident power 20. The ridges 24 or 26 are spaced apart a distance h, which means that the dielectric strips 14, as measured between a center line of such strips, or between corresponding edges, are also spaced apart a distance h. The dielectric strips 14 have a width of h', and a thickness d. Thus, the total thickness of the barrier 12, i.e., the distance from the front side to the back side of such barrier, is a distance d when measured at the dielectric strips 14, and is a distance 2L+d when measured between the ridges of the metallic strips 16. The thickness d is chosen to be an integral number of half wavelengths of the incident microwave radiation 20. The width h' is chosen to preferably be less than $\lambda_0/2$. Such selection of h' helps insure that only the lowest mode exists at the vacuum dielectric interface.

Conceptually, as the incident microwave power 20 strikes the front of the barrier 12, some of the power passes directly through the thickness d of the dielectric strips 14. The rest of the incident power 20 strikes one side or the other of the taper 22, and is reflected into the dielectric strip 14. In this way, the taper of the metallic strips 14 funnels the microwave power through the dielectric strips 14. Stated more precisely, the tapers 22 of the metallic strips 16 match the free space incident radiation 20 into a parallel plate structure. It is referred to as a "parallel plate structure" because the tapers and dielectric strips extend the full width of the waveguide.

As the microwave power passes through the dielectric strips 14, some power is absorbed in the strips 14, causing the temperature of the strips 14 to rise. A primary function of the metallic strips 16, which are thermally as well as physically bonded to the dielectric strips 14, is to provide a heat sink for removing excessive heat from the dielectric strips. Thus, the metallic strips 16 may also be considered as cooling strips. To enhance the cooling function of the strips 16, at least one cooling channel 18 is placed inside of each strip 16. A suitable coolant, such as water, is then pumped through the channel 18 in order to more efficiently remove heat therefrom. In this manner, a good thermal path is provided for dissipating the temperature rise of the dielectric strips 14.

In order to preserve the correct mode of the incident microwave power 20 as it passes through the window barrier 12, it is important that the strips 14 and 16 assume a prescribed orientation relative to the transverse electric field of the incident wave of microwave power 20. More particularly, it is necessary that the strips 14 assume a perpendicular orientation relative to the transverse electric field of the incident wave 20. Such orientation is also illustrated in FIG. 2A, where the incident wave 20 is depicted as having an electric field component that points up, as indicated by the arrow 28, as well as a magnetic field component that points out of the paper, as indicated by the dot-in-the-center-of-a-circle symbol 30. The strips 14 and 16 are shown in FIG. 2A in cross section, meaning that each strip longitudinally extends into or out of the paper. Thus, such strips 14 and 16 have the requisite perpendicular relationship relative to the electric field component 28 of the incident microwave power 20.

Figure 2B:
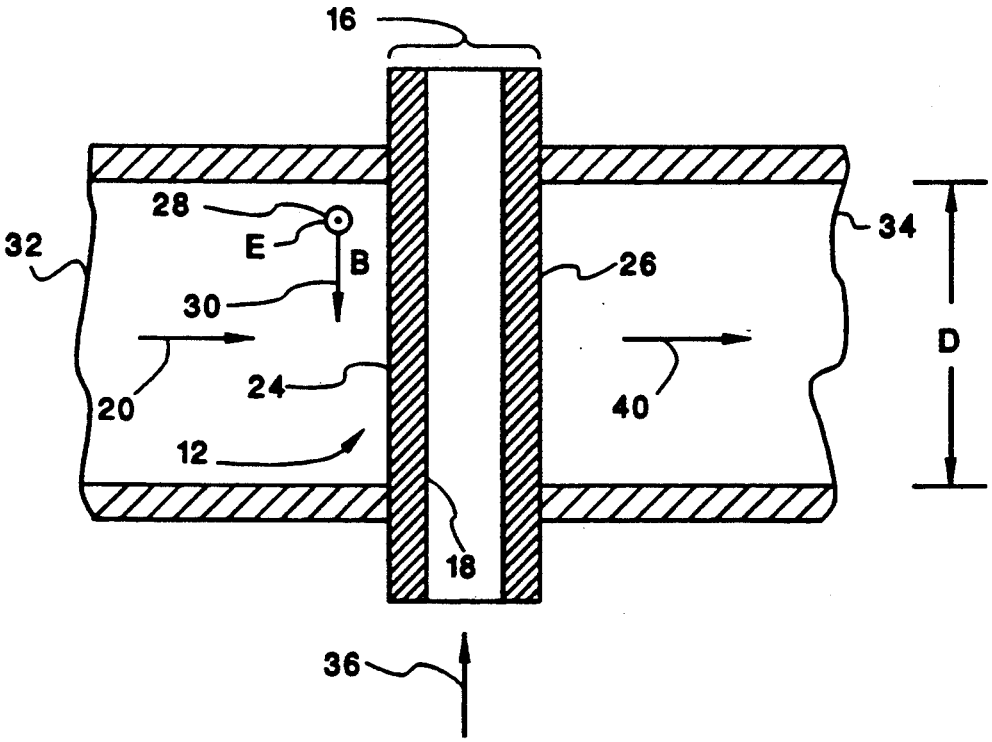
FIG. 2B illustrates a cross-sectional view through one of the coolant channels of a metallic strip used within the microwave window of the present invention.

The relationship between the orientation of the strips 14 and 16 and the incident wave 20 is further illustrated in FIG. 2B. FIG. 2B shows a cross-sectional view through one of the coolant channels 18 of a metallic strip 16 used within the microwave window of the present invention. FIG. 2B further illustrates how the window barrier 12 extends across the full diameter D of the first waveguide 32 and the second waveguide 34, thereby providing a physical barrier between the waveguides 32 and 34. As is known in the art, such physical barrier is needed for many applications because of different pressures or different gases that may be present or desired in one waveguide, but not in the other. In the view of FIG. 2B, the incident microwave power 20 still includes transverse electric and magnetic field components, but such components are rotated 90 degrees from that shown in FIG. 2A. Thus, the magnetic field component 30 depicted in FIG. 2 points down, while the electric field component 28 points out of the paper. The coolant channel 18 extends the full length of the metallic strip 16, thus allowing a suitable coolant (such as water) to flow through the channel in the direction shown by the arrow 36. (It is noted that the direction shown by the arrow 36 is only exemplary. The coolant may flow in either direction through the channel 18.) As evident in FIG. 2B, the metallic strips 16, and hence the dielectric strips 14 (not visible in FIG. 2B, but which are parallel to the metallic strips 16) remain perpendicular to the electric field component 28 of the incident wave 20, thereby maintaining the requisite orientation between the strips and the electric field.

In operation, as shown in FIG. 2B, the incident microwave power 20, propagating through the first waveguide 32, strikes the window barrier 12, which barrier 12 presents a physical and vacuum barrier between the first waveguide 32 and the second waveguide 34. Both waveguides are advantageously of the same size, having a diameter D, which is generally a relatively large dimension, e.g., 8.8 cm at 110 GHz. Most of the power passes through the dielectric strips 14 of the barrier 12 and continues propagating in the second waveguide 34 as transmitted radiation 40. Some of the power is absorbed in the barrier 12, and the temperature rise associated with such absorption is minimized or otherwise controlled by the coolant flow through the metallic strips 16. Advantageously, the microwave power is thus coupled between the first waveguide 32 and the second waveguide 34 without the need for any transitions to other waveguide shapes or diameters.

Figure 3:
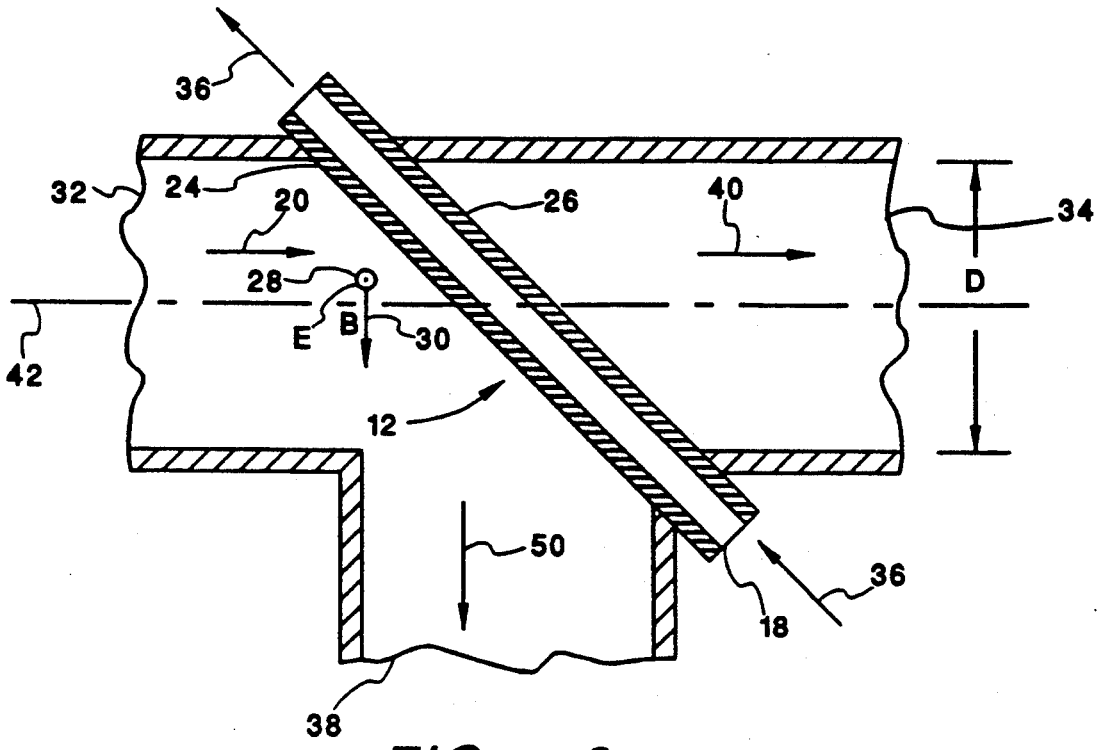
FIG. 3 depicts a cross-sectional view as in FIG. 2B where the barrier created by the stacked alternating dielectric and metallic strips is tilted relative to the waveguide axis.

In accordance with one aspect of the invention, the window barrier 12 may be tilted with respect to an axis 42 of the waveguide 32 or 34 as shown in FIG. 3. Note, like FIG. 2B, FIG. 3 shows a cross-sectional view of the window barrier 12 through the coolant channel 18 of one of the metallic strips 16. Unlike FIG. 2B, a third waveguide 38 is positioned to receive any microwave power 50 that reflected off of the barrier 12. Such third waveguide 38 couples such reflected power 50 to a suitable load or absorber (not shown). The reflected power 50 is typically power that is of the wrong mode or polarization, thereby allowing the transmitted power 40 to maintain a desired mode or polarization. Use of the tilted barrier 12 as shown in FIG. 3, with its concomitant third waveguide 38 and absorber, thus offers the further advantage of minimizing the amount of power that might otherwise be reflected back to the microwave source, which reflected power might otherwise cause the source to be made unstable.

Even when the barrier 12 is tilted, as shown in FIG. 3, it is still important for proper operation of the window, i.e., to assure that the desired incident mode (the $HE_{11}$ mode) is transmitted through the window, to maintain the correct orientation between the strips 14 and 16 and the transverse electric field component 28 of the incident power 20. For the view shown in FIG. 3, the electric field component 28 of the incident wave points out of the paper. The strips 14 and 16, while angled or tilted relative to the waveguide axis 42, remain perpendicular to such electric field component 28. Hence, the requisite orientation is maintained.

A more precise explanation will now be given of the manner in which the incident power, presumed to be in the $HE_{11}$ mode, passes through the barrier 12. Regardless of the configuration, e.g., regardless of whether the barrier 12 is orthogonal to the waveguide axis as shown in FIGS. I and 2A–2B, or tilted relative to the waveguide axis, as shown in FIG. 3, the $J_0$ Bessel function profile of the electric and magnetic fields may be approximated by a series of steps of width h, where h is the spacing between the dielectric strips as shown in FIG. 2A. The larger the diameter D of the waveguide, the better the approximation for a given h. It is necessary that the dimension h be less than $\lambda_0$, where $\lambda_0$ is the free space wavelength of the incident microwave power 20. If this condition is not met, a substantial amount of the incident power could be scattered to modes other than the $HE_{11}$ mode. There is no theoretical limit on how small h may be, since with the specific polarization there is no cutoff for the fundamental parallel plate mode. In practice however, the dielectric strips 14 (which are typically made from sapphire, but may be made from other dielectric materials as well) cannot be made too thin else they will not be able to resist stresses from differential thermal expansion. Also, the coolant channels 18 used within the cooling strips 16 cannot, as a practical matter, be made arbitrarily small. Hence, for a typical design, h should generally be selected to be only slightly smaller than $\lambda_0$.

To estimate the quality of the stair step approximation, a square $HE_{11}$ mode corrugated waveguide is considered, for which the filed profile is sinusodial. An electrical field component $E_y=E_0\cos(\pi x/2a)\cos(-\pi y/2a)$, where the waveguide is 2a by 2a on a side, may be decomposed in a Fourier series in each channel of width h. Considering only the cut through x=0, which is typical, it is seen that:

$$\cos\left(\frac{\pi y}{2a}\right)=\sum_{n=0}^{\infty} a_{mn}\cos[(y-y_m)n\pi/h], \tag{1}$$

for $y_m \geqq y \geqq y_m+h$, where $y_m=(mh-h/2)$. Then, $a_{mn}$ is the $n^{th}$ Fourier component in the $m^{th}$ channel. For $h<\lambda_0$, only the n=0 and n=1 modes propagate at the mouth of the taper. Using the orthogonality of the cosine functions for different n values, it is seen that $$a_{m0}=\frac{\sin(h\pi/4a)}{(h\pi/4a)}\;\frac{\cos(mh\pi)}{2a}\text{, where } (mh)=\underbrace{y_m+h/2}_{\text{center of the } m^{th}\text{ slot}} \tag{2}$$

and $$a_{m1}=-\frac{2}{\pi}\;\frac{(h/a)}{1-(h/2a)^2}\left[\sin\left(\frac{mh\pi}{2a}\right)\cos(\pi h/4a)\right]. \tag{3}$$

In general, then, $$a_{mn}=\frac{2}{\pi}\;\frac{1}{n^2}\;\frac{(h/a)}{1-(h/2na)^2}\begin{Bmatrix}+\sin(mh\pi/2a)\cos(\pi h/4a) & n\text{ odd,}\\ -\sin(mh\pi/2a)\sin(\pi h/4a & n\text{ even.}\end{Bmatrix} \tag{4}$$

Since $a_{mn}$ is proportional to $1/n^2$, the most important term compared to the total power is $$R = \frac{\int_{-a}^{a} E^2 dx \text{spurious}}{\int_{-a}^{a} E^2 dx \text{incident}} = \frac{\sum_{m=-M}^{M} a_{m1}^2 \int_0^h \cos^2(\pi x/h)dx}{\int_{-a}^{a} \cos^2(\pi x/2a)dx},$$

which reduces to $$R = \frac{\left(\frac{2}{\pi}\right)^2 \frac{(h/a)^2}{[1-(h/2a)^2]^2} \cos^2(\pi h/4a)(h/2) \sum_{m=-M}^{M} \sin^2(m\pi h/2a)}{a}, \tag{5}$$

$$\simeq \left(\frac{2}{\pi}\right)^2 (h/a)^2 \frac{h}{2a} \sum_{m=-M}^{M} \sin^2 \frac{m\pi h}{2a} \text{ where}$$

$$Mh \simeq a \text{ and assuming } h < a, \simeq \frac{1}{2}\left(\frac{2}{\pi}\right)^2 (h/a)^2.$$

As an example, if a=3.175 cm, $\lambda_0$=0.273 cm, and h=0.2 cm, then $R=0.83\times10^{-3}$, which is acceptably small.

Another consideration is the design of a microwave window in accordance with the present invention is the heating of an stress in the dielectric strip 14. It is noted that in the description that follows, a square waveguide is considered. However, it is also noted that the round corrugated waveguide and the square corrugated waveguide both propagate the $HE_{11}$ mode. The circular waveguide is easier to make, but the square waveguide is easier to analyze, because it uses trigonometric functions, while the circular waveguide analysis requires bessel functions. The $HE_{11}$ mode is practically identical in the two types of waveguides, if the waveguide diameter $D\simeq1.08\times2a$, where 2a is the square waveguide width. Again, considering the square waveguide having dimensions of 2a by 2a, the incident power/unit area may be expressed as $$P = \frac{P_0}{a^2} \cos^2 \frac{\pi x}{2a} \cos^2 \frac{\pi y}{2a}, \tag{6}$$

where $P_0$ is the total power. If the dielectric has a complex relative dielectric constant or relative permittivity of $=\epsilon'+i\epsilon''$, the power dissipated by a traveling wave of power $P_0$ is just $P_{diss}=P_0k_\epsilon(\epsilon''/\epsilon')$ per unit length, where $k_{68}=(\epsilon')^{\frac{1}{2}}2\pi/\lambda_0$. There is, however, a large reflected wave within the dielectric, even though the thickness d is chosen to be an integral number of half wavelengths so that there is no reflection at the boundaries as seen from the outside of the dielectric. Thus, assuming $$E_y = Ae^{ik_\epsilon z} + Be^{-ik_\epsilon z}, \tag{7}$$

and $$H_x = \frac{\sqrt{\epsilon}}{377}[Ae^{ik_\epsilon z} - Be^{-ik_\epsilon z}], \tag{8}$$

then the continuity of $E_y$ and $H_x$ at the boundaries gives $A+B=E_0$ and $A-B=E_0(\epsilon')^{178}$ if there is no external reflected wave. The magnitude of the electric field, to which the dielectric loss is proportional, is $$|E_y|^2 = E_0^2\{\cos^2 k_\epsilon z + \sin^2 k_\epsilon z/\epsilon'\} \tag{9}$$

The integral of $|E_y|^2$ from 0 to d is then $$\int_0^d |E_y|^2 dz = (d/2)(1 + 1/\epsilon')E_0^2. \tag{10}$$

where $E_0$ in this instance is the amplitude of the incident electric field in a vacuum.

To relate $E^2_y$ to dissipation, it is necessary to use $$J = \tfrac{1}{2}\epsilon_0(dE/dt) \tag{11}$$

and from Poynting's theorem $$P_{diss}/VOL = Re(\tfrac{1}{2}J\cdot E^*) = \tfrac{1}{2}\omega\epsilon_0\epsilon''E\cdot E^* \tag{12}$$

which must be compared with the power incident on the dielectric $$P_0' = \tfrac{1}{2}E\times H^*W/\text{unit area}, \tag{13}$$

where $\epsilon_0=8.85\times10^{-12}$ f/m. In free space, $E_y/H_x=377$ ohm. Therefore, $P_0'$ is equal to $\frac{1}{2}|E_0|^2/377$, assuming no net reflections. The total power dissipated across the thickness d of the dielectric strip is thus:

$$\frac{1}{2}\omega\epsilon_0\epsilon''\int_0^d |E_y|^2 = \frac{1}{2}\omega\epsilon_0\epsilon''\frac{d}{2}(1 + 1/\epsilon')E_0^2 = \frac{1}{2}\omega\epsilon_0\epsilon''\frac{d}{2}(1 + 1/\epsilon')2P_0'377. \tag{14}$$

Since $1/\epsilon_0c=377\ \Omega$, where c is the speed of light, dividing the above expression by the thickness d gives the power dissipated per unit volume when $P_0'$ is the incident power per unit area at the dielectrics, as follows:

$$P_{diss}/\text{cm}^3 = \frac{1}{2}\left(\frac{\omega}{c}\right)\epsilon''(1 + 1/\epsilon')P_0' \tag{15}$$

where $P_0'$ is the incident power expressed in W/cm$^2$, and $(\omega/c)$ is expressed in cm$^{-1}$.

As an example, for a dielectric sapphire, $\epsilon'=9.3$ and $\epsilon''/\epsilon'=2\times10^{-4}$at 110 GHz and $\omega/c=23.04$ cm$^{-1}$ at 110 GHz. This results in a dissipated power of $P_{diss}=1.98\times10^{-2}P_0'$ W/cm$^3$. For $P_{incident}=1$ MW total, and assuming a square waveguide for which $P_0 = P_{incident}/a^2$, then $P_0$ is $10^6/16$ W/cm$^2$ at the center of the window, which is enhanced by the taper. Assuming a ratio of h/h' (see FIG. 2A) of 0.2 cm/0.075 cm, then $P_{0'} = P_0(h/h') = 1.66 \times 10^5$ W/cm$^2$ at the at the dielectric. This means that the average dissipation in the dielectric, $P_{diss}$, is about $3.3 \times 10^3$ W/cm$^3$. The one-dimensional solution to the heat diffusion equation then gives $$\Delta T = T_{center} - T_{edge} = \frac{P_{diss}}{\kappa} \frac{b^2}{2}. \tag{16}$$

Figure 4:
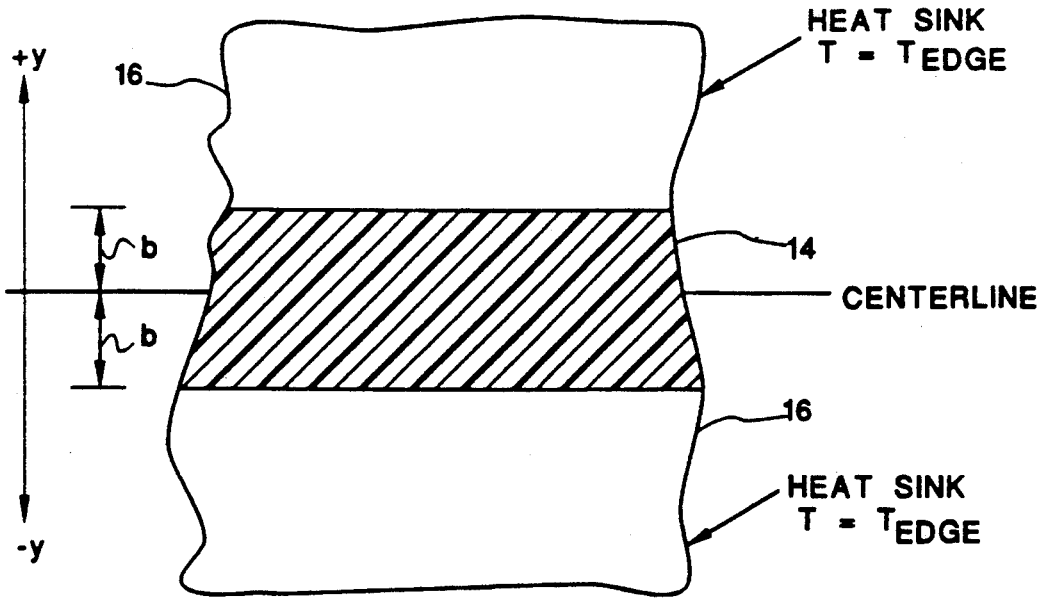
FIG. 4 diagrammatically defines the dimensions used in a thermal analysis of the invention.

Turning next to FIG. 4, a partial view of the dielectric 14 bounded by the metallic strips 16 is shown in order to diagrammatically define the dimensions used in the following thermal analysis. The value of $\kappa$ for sapphire is 0.32 W/cm$^2$/C°/cm. Assume that 2b=h' is 0.075 cm. Then $\Delta T = 7.2°$ C., which gives very low stress. The stress may be computed as $$\sigma_x = \{\tfrac{3}{8}[1-(y/b)^2]\} \times \alpha E \Delta T, \tag{17}$$

assuming the walls have no restraint. At the center (y=0), the stress is compressive, while at the edge (y=b/2), it is tensile. In the above expression, $\alpha$ is the coefficient of thermal expansion ($5.3 \times 10^{-6}$/° C. for sapphire). For a temperature difference as indicated by $\Delta T$, the tensile stress at the edge is $1.6 \times 10^3$ psi, compared with a tensile strength of 300 to $500 \times 10^3$ psi. Such values are very conservative values of the temperature difference, $\Delta T$, and the stress, $\sigma_x$, which are achieved by making the width h' of the dielectric strip small, so that the heat conduction path is very short.

The actual dissipation in the dielectric strip depends on the thickness d and the width h'. Assuming h'=0.075 cm and d=0.269 cm (three wavelengths in the sapphire), the heat input per unit width is $P_1 = 66$ W/cm, while the power per unit area of the heat sink is $P_2 = 123$ W/cm$^2$ per side. These are all peak values at the hottest spot in the center of the window barrier. The total heat dissipated in the central strip is thus:

$$\begin{aligned} P_{1tot} &= \int_{-a}^{a} P_1 \cos^2\left(\frac{\pi}{2}\ \frac{X}{a}\right) dx = P_1 a \\ &= 264\ W = 63 \text{ cal/sec.} \end{aligned} \tag{18}$$

Figure 5:
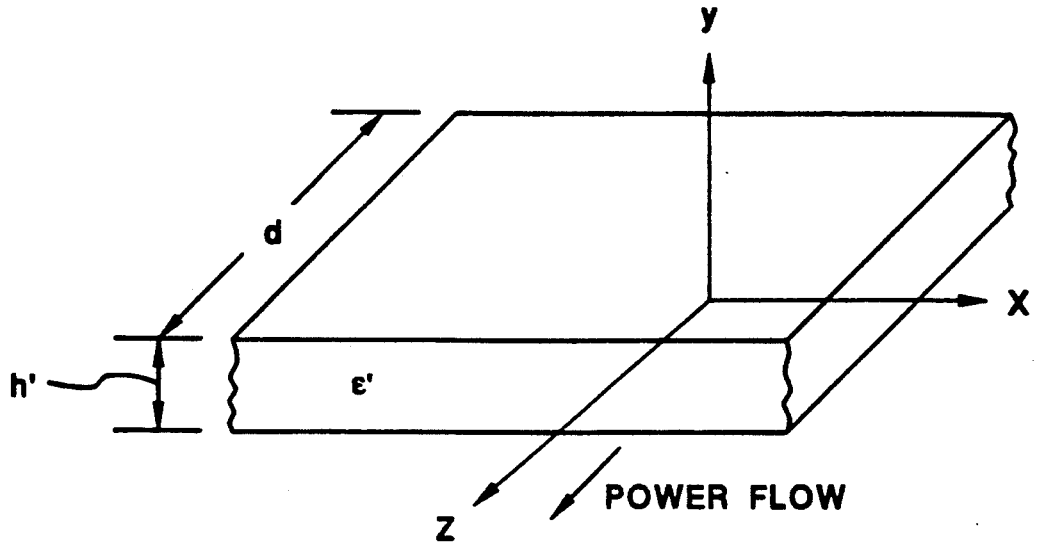
FIG. 5 defines the coordinate system and linear dimensions associated with an ohmic loss analysis of the invention.

In addition to the thermal considerations addressed above relative to dielectric loss, the design of a microwave window in accordance with the present invention should also take into consideration the ohmic losses that occur within the dielectric strips 14. Adopting the same notation used above, and with reference to FIG. 5 for a definition of the applicable parameters and coordinate system, it can be shown that the electric and magnetic field components may respectively be expressed as:

$$E_y = Ae^{ik_\epsilon z} + Be^{ik_\epsilon z}, \tag{19}$$

and $$H_x = \frac{\sqrt{\epsilon}}{377}\,[Ae^{ik_\epsilon z} - Be^{ik_\epsilon z}]. \tag{20}$$

At z=0, it can be shown that $A+B=E_0$, $(A-B)(\epsilon')^{\frac{1}{2}}/377 = H_0$, and $E_0 = 377H_0$. From such determination, it can further be shown that $$|H_x|^2 = \epsilon'\left(\frac{E_0}{2 \times 377}\right)^2 [(1 + 1/\sqrt{\epsilon})^2 + (1 - 1/[\sqrt{\epsilon})^2 - (1 + 1/\sqrt{\epsilon})(1 - 1/\sqrt{\epsilon})2\cos(2k_\epsilon z)]. \tag{21}$$

Assuming that the thickness d is an integral number of half wavelengths, the average value of $|H_x|^2$ is $$\frac{1}{d}\int_0^d |H_x|^2 dz = (1/2)\left(\frac{E_0}{377}\right)^2 (1 + \epsilon'). \tag{22}$$

It is noted that use of the average value is appropriate in this instance because the distance between a standing wave minimum and maximum is only about 0.009 inches in sapphire at a frequency of 110 GHz. At each surface, the power dissipated per square centimeter is $P_{diss} = R'|H_x|^2$, where R' is the surface resistance, and may be expressed as $R' = \mu_0\omega\delta/4$, where $\delta$ is the skin depth in meters, and $\mu_0$ is the permeability of free space. For comparative purposes, for ideal copper at 110 GHz, R'=0.05 Ω. In terms of the incident power/cm$^2$ at the dielectric, $P_0'$, it can be shown that the power dissipated at each surface due to ohmic loss is $$P_{diss} = \left(\frac{R'}{377}\right)(1 + \epsilon')P_0'. \tag{23}$$

As an example, if it is assumed that the incident power is 1 MW, then $P_0' = 166 \times 10^5$W/cm$^2$ at the dielectric. This means that the dissipated power on each side of the central strip is about 227 W/cm$^2$. This value translates to a dissipation of 1% of the incident power if the sapphire dielectric is three wavelengths thick. To this heat flux must be added the 123 w,/cm$^2$ per side from the electric loss, for a total of 350 w/cm$^2$. Such a heat flux can be easily carried away by flowing water without using special techniques. However, the above analysis points out that the limiting factor in determining the size of the window is normally the ability to remove heat therefrom, as opposed to the stresses in the dielectric.

A further issue to be addressed in the design of a microwave window made in accordance with the present invention is the reflections that occur from the tapers of the metallic strips. The refection from a linear E plane taper is given in Johnson, R.C. *IRE Transactions of Microwave Theory and Techniques,* Vol. 7, pp. 374–376 (1959). In terms of the dimensions defined in FIG. 2A, the reflection coefficient, Γ, is expressed as:

$$\Gamma = -i(\lambda_0/8\pi L)[(h-h')^2/hh'] \tag{24}$$

assuming that L is a multiple of $\lambda_0/2$, which should be the case if Γ is to be minimized. For a spacing h of 2 mm, a dielectric width h' of 0.75 mm, and $L = 2\lambda_0 = 0.55$ cm, Γ is equal to −i0.021. The reflected power is $|\Gamma|^2$, which is equal to 0.00043 of the incident power, which is negligible. Even if L were chosen to be equal to $\lambda_0$, the reflection would still be insignificant. However, a larger L makes a stronger window and barrier, capable of withstanding atmospheric forces.

Figure 6:
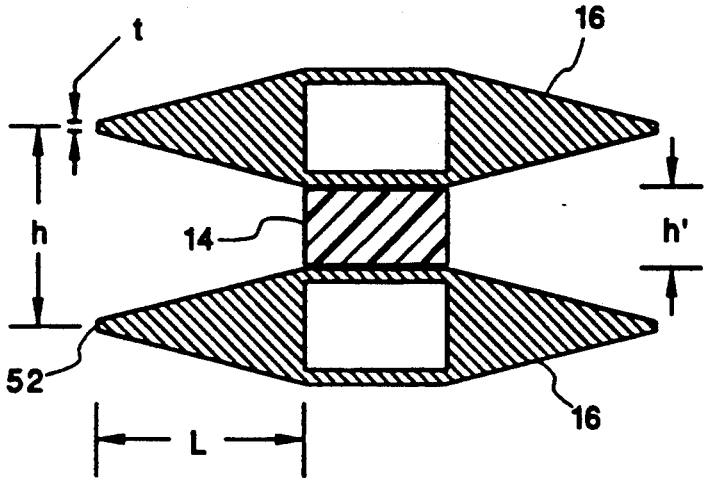
FIG. 6 shows a typical cross-sectional view of a portion of a barrier as in FIG. 1 with blunt tapers.

Another point to consider is th difficulty in making a perfectly sharp taper, i.e., a taper having a perfectly sharp edge. Rather, the taper will generally assume a cross-sectional shape as shown in FIG. 6, wherein the taper has a blunt tip 52, having a width t. Thus, there is an additional reflection from the blunt tip 52 that must be considered. For the geometry shown in FIG. 6, it can be shown that the total reflection coefficient is $$\Gamma = -i\frac{\lambda_0}{8\pi L}\ \frac{(h-t-h')^2}{(h-t)h'} + \frac{t}{2h-t}. \tag{25}$$

Since the terms of the above expression are out of phase, due to the $i \equiv (-1)^{\frac{1}{2}}$ element in the first term, the terms cannot cancel. However, the reflection at the expanding taper at the other end (other side of the barrier 12) is of the opposite sign of the reflection of the converging taper, and the total path length is an integral number of half wavelengths. Hence, the net reflection is zero at the design frequency. For example, if t=0.025 cm and h=0.2 cm, the second term gives a reflection coefficient, Γ, of 0.066. Such term is not entirely negligible by itself. Fortunately, however, cancellation by reflection at the second taper does eliminate it.

As indicated above, the dielectric strips 14 are brazed to the adjoining metallic strips. Sapphire strips as long as 4 inches can and have been successfully brazed to niobium or molybdenum using active copper-silver alloys. Hence, the metallic strips may be made from niobium or molybdenum. The metallic strips 16 are made from one piece of metal, with the coolant channels 18 being formed using wire EDM (electric discharge machine) techniques, as is known in the art.

As described above, it is thus seen that the present invention provides a microwave window that may be used directly with large diameter waveguides, e.g., waveguides having a diameter on the order of $\approx 30\lambda_0$ (e.g., 8 cm at 110 GHz) or larger.

It is also seen that the invention provides a microwave window that couples microwave power in the $HE_{11}$ mode directly from one large diameter waveguide to another without the need for any transitions to other shapes or diameters.

It is further seen from the above description that the invention provides a microwave window that includes cooling means for efficiently removing heat from the dielectric medium that forms the barrier of such microwave window.

Finally, it is seen that the invention provides a microwave window that includes a vacuum barrier that may be transverse to the waveguide axis, or tilted with respect to the waveguide axis; and that when tilted provides for the deflection of microwave power of an unwanted mode, or microwave power of the wrong polarization, into an absorber.

While the invention herein disclosed has been described by means of specific embodiments and applications thereof, numerous modifications and variations could be made thereto by those skilled in the art without departing from the scope of the invention set forth in the claims.

What is claimed is:

1. A distributed microwave window for use within a microwave waveguide comprising:

a plurality of alternating dielectric and metallic strips stacked and sealed to form a vacuum barrier;

said vacuum barrier being positioned and sealed so as to provide a physical barrier within the interior of said waveguide;

each of said plurality of dielectric strips having a substantially rectangular cross-sectional shape; with a first set of opposing sides being sealed to respective sides of adjacent ones of said metallic strips, and with a second set of opposing sides fronting the interior of said waveguide; and each of said metallic strips having a substantially hexagonal cross-sectional shape, with a first set of opposing sides being sealed to respective sides of adjacent ones of said dielectric strips, and with a second and third set of opposing sides of said hexagonal-shaped metallic strip being exposed to the interior of said waveguide to form a taper.

2. The microwave window as set forth in claim 1 wherein said metallic and dielectric strips of said vacuum barrier are oriented within said waveguide to be perpendicular to a transverse electric field component of an incident wave of electromagnetic microwave radiation that is propagating through said waveguide.

3. The microwave window as set forth in claim 2 wherein a plurality of said metallic strips each include at least one coolant channel that passes longitudinally therethrough, and further including a coolant that passes through said at least one coolant channel.

4. The microwave window as set forth in claim 3 wherein said vacuum barrier lies in a plane that is substantially perpendicular to a longitudinal axis of said waveguide.

5. The microwave window as set forth in claim 3 wherein said vacuum barrier lies in a plane that is tilted with respect to a longitudinal axis of said waveguide.

6. The microwave window as set forth in claim 3 wherein the second and third set of opposing sides of said hexagonal-shaped metallic strip combine to form a taper on each side of the vacuum barrier for each one of said metallic strips, each of said tapers having a ridge that extends the length of said metallic strip, said ridge being a distance L from a frontal plane of said vacuum barrier, said vacuum barrier having a thickness d through the dielectric strips, and a thickness 2L+d through the ridge of the tapers of the metallic strips, each dielectric strip having a width h', and a spacing between adjacent ridges of h, where h is $<\lambda_0$, where $\lambda_0$ is the free space wavelength of the electromagnetic radiation propagating through said waveguide.

7. The microwave window as set forth in claim 6 wherein $L=n\lambda_0/2$, where n is an integer.

8. The microwave window as set forth in claim 6 wherein each dielectric strip is made from sapphire.

9. The microwave window as set forth in claim 6 wherein said coolant comprises water.

10. The microwave window as set forth in claim wherein said coolant comprises Syltherm 800.

11. Coupling apparatus for coupling microwave power between the $HE_{11}$ mode in a first waveguide to the $HE_{11}$ mode in a second waveguide, said apparatus comprising:

a vacuum barrier separating said first and second waveguide, said vacuum barrier including a plurality of parallel dielectric strips, each dielectric strip being separated from an adjacent dielectric strip by a cooling strip, the distance between a center line of adjacent dielectric strips being a distance h, where $h<\lambda_0$, where $\lambda_0$ is the free space wavelength associated with the microwave power being coupled between said first and second waveguide;

the dielectric strips of said vacuum barrier being oriented so as to be longitudinally perpendicular to an electric field component of said microwave power.

12. The coupling apparatus as set forth in claim 11 wherein the thickness of said vacuum barrier is a distance d through said dielectric strips, and is a distance d+2L through the thickest part of said cooling strips, whereby each cooling strip extends perpendicularly out from a plane surface of said dielectric strips a distance L.

13. The coupling apparatus as set forth in claim 12 wherein each of said dielectric strips has a width h', and where $h' < \lambda_0/2$.

14. The coupling apparatus as set forth in claim 12 wherein each cooling strip includes a taper on each side of said vacuum barrier, said taper extending the full length of said cooling strip, a ridge of said taper being said distance L from said plane surface.

15. The coupling apparatus as set forth in claim 14 wherein each cooling strip comprises a metallic strip that has at least one cooling channel passing longitudinally therethrough, and a coolant flowing through each cooling channel.

16. The coupling apparatus as set forth in claim 15 wherein said first and second waveguide have a waveguide axis, and wherein said vacuum barrier is substantially orthogonal to said waveguide axis.

17. The coupling apparatus as set forth in claim 15 wherein said first and second waveguide have a waveguide axis, and wherein said vacuum barrier is tilted relative to said waveguide axis.

18. The coupling apparatus as set forth in claim 17 further including a third waveguide coupled for a power absorber, said third waveguide being positioned to receive microwave power reflected off of said vacuum barrier and direct said reflected microwave power to said absorber.

19. The coupling apparatus as set forth in claim 15 wherein said first and second waveguide each have a diameter of at least $30\lambda_0$.

20. The coupling apparatus as set forth in claim 15 wherein each of said dielectric strips comprise a strip of sapphire.

* * * * *

UNITED STATES PATENT AND TRADEMARK OFFICE

CERTIFICATE OF CORRECTION

PATENT NO. : 5,313,179

DATED : May 17, 1994

INVENTOR(S) : Moeller

It is certified that error appears in the above-identified patent and that said Letters Patent is hereby corrected as shown below:

IN THE CLAIMS: Claim 10, Column 14, line 52, after "Claim", insert --6--. Claim 18, column 16, line 52, change "for" to --to--.

Signed and Sealed this

Twenty-seventh Day of September, 1994

*Attest:*

*Attesting Officer*

Bruce Lehman

BRUCE LEHMAN

*Commissioner of Patents and Trademarks*